US006202442B1

(12) United States Patent
Brugerolle

(10) Patent No.: US 6,202,442 B1
(45) Date of Patent: Mar. 20, 2001

(54) INTEGRATED APPARATUS FOR GENERATING POWER AND/OR OXYGEN ENRICHED FLUID AND PROCESS FOR THE OPERATION THEREOF

(75) Inventor: Jean Renaud Brugerolle, Paris (FR)

(73) Assignee: L'Air Liquide, Societe Anonyme pour l'Etude et l'Expoitation des Procedes Georges Claude, Paris Cedex (FR)

( * ) Notice: Subject to any disclaimer, the term of this patent is extended or adjusted under 35 U.S.C. 154(b) by 0 days.

(21) Appl. No.: 09/285,794

(22) Filed: Apr. 5, 1999

(51) Int. Cl.[7] ..... F25J 3/00
(52) U.S. Cl. ..... 62/649; 62/646; 60/39.12
(58) Field of Search ..... 62/640, 915, 643, 62/648, 649, 650, 646; 60/39.12

(56) References Cited

U.S. PATENT DOCUMENTS 4,224,045 * 9/1980 Olszewski et al. ..... 62/646
5,224,336 * 7/1993 Agrawal et al. ..... 62/643
5,388,395 * 2/1995 Scharpf et al. ..... 60/39.02
5,437,150 * 8/1995 Latham et al. ..... 60/39.02
5,596,885 * 1/1997 Grenier ..... 62/646
5,609,041 * 3/1997 Rathbone et al. ..... 62/646
5,666,823 * 9/1997 Smith et al. ..... 62/646
5,722,259 * 3/1998 Sorensen et al. ..... 62/646

* cited by examiner

*Primary Examiner*—William Doerrler
(74) *Attorney, Agent, or Firm*—Young & Thompson

(57) ABSTRACT

In an integrated power generation system, part of the air from a gas turbine compressor is separated in a single nitrogen wash column to remove oxygen and the gaseous nitrogen produced at the top of the column is sent back to a point upstream of the expander of the gas turbine. The wash column may be fed with liquid nitrogen from an independent air separation unit in which air is separated. Liquid from the bottom of the wash column may be fed back to the air separation unit.

26 Claims, 6 Drawing Sheets

INTEGRATED APPARATUS FOR GENERATING POWER AND/OR OXYGEN ENRICHED FLUID AND PROCESS FOR THE OPERATION THEREOF

TECHNICAL FIELD OF THE INVENTION

The present invention relates to an integrated apparatus for generating power and/or oxygen-enriched fluid and a process for the operation thereof.

BACKGROUND OF THE INVENTION

All present oxygen production facilities extract oxygen from air. Air has the advantage of being free and available everywhere. One of the drawbacks is that because air is at atmospheric pressure, it contains a lot of water and CO2 at low partial pressure. And pressure drops in process cycles are energy expensive close to atmospheric pressure. It is the reason why most oil, chemical or petrochemical processes operate in the range of 10–40 bar. The pressure drops are less costly, heat exchange is easier, and the size of plants is reduced, drastically decreasing overall cost.

In the case of oxygen production, as air contains 80% nitrogen, a low pressure waste gas containing the nitrogen is normally produced. In case of cryogenic distillation, the cold heat contained in the waste nitrogen has to be recuperated through heat exchangers which are costly both in investment and related energy needs.

Some oxygen plants operate at higher than normal pressure with some means and additional investment to recover the energy lost in the waste nitrogen.

FIG. 1 shows a basic power gas turbine arrangement in which an air compressor 1 sends air 3 at between 8 and 35 bar to a combustor 5 fed by fuel 6. The combustion gas 7 mixed with dilution air 4 forms mixture stream 8 which is expanded in gas turbine 9 having an inlet temperature between 900 and 1400° C. and generates power. To achieve good combustion in the bumer, a close to stoichiometric mixing is necessary to use fuel efficiently and produce minimum pollution. But in this case, combustion produces a hot gas at temperatures higher than 2000° C., well above what any kind of hot turbine can accept. For this reason, quench type cooling takes place by mixing this very hot flue gas 7 with compressed dilution air 4 from the compressor at the same pressure as stream 3 but much lower temperature. The dilution air flow 4 is of the same order of magnitude as the combustion air flow 3.

Because this dilution air 4 does not participate in the combustion, oxygen is not necessary. So it is possible to extract the oxygen contained in the dilution air 4 as shown in FIG. 2. The air 4 is cooled, purified and distilled in separation unit 12 producing oxygen 10 and nitrogen 11. The nitrogen 11 is mixed with combustion gas 7.

Generally the separation unit used is a double column comprising a thermally linked high pressure column and low pressure column. However it is known to use a single column with a top condenser and a bottom reboiler for this purpose.

If the amount of nitrogen 11 is limited, it may alternatively be mixed with air stream 3 and sent to combustor 5 as described in U.S. Pat. No. 4,224,045. Another option is to send the nitrogen to be mixed with the fuel stream 6.

SUMMARY OF THE INVENTION

According to the present invention, there is provided an integrated apparatus for generating power and/or oxygen enriched fluid comprising a first air separation unit, a gas turbine comprising a combustor and an expander, a first compressor, means for sending air from the first compressor to the combustor and to the air separation unit, means for sending combustion gases from the combustor to the expander, means for sending nitrogen from the air separation unit to a point upstream of the expander and means for either compressing the nitrogen sent to a point upstream of expander, further compressing the air sent to the first air separation unit from the first compressor or expanding the air sent to the combustor from the first compressor characterized in that the first air separation unit comprises at least a single column fed by air and the apparatus comprises means for sending liquid nitrogen from an external source to the top of the single column, said external source not being a condenser fed by gaseous nitrogen from the top of the single column, and means for removing gaseous nitrogen from the top of the single column and for removing an oxygen-enriched fluid from the bottom of the column.

According to further optional aspects of the invention:

the single column has no bottom reboiler and no top condenser;

the apparatus comprises a second compressor and means for sending air from the further compressor to the single column;

the external source of liquid nitrogen is a second air separation unit comprising at least one distillation column;

the second air separation unit comprises a high pressure column and a low pressure column which are thermally linked;

there are means for withdrawing the liquid nitrogen from the high pressure column or the low pressure column, where necessary pressurizing it and sending it to the top of the single column in liquid form and/or means for sending the oxygen-enriched liquid from the bottom of the single column to the high pressure column and/or the low pressure column;

there are means for sending air to the double column from one of the first, second or a third compressor;

Alternatively there may be means for sending gaseous nitrogen from the single column to the double column and/or means for sending nitrogen from the double column to a point upstream of the expander.

The apparatus may additionally include a gasifier, means for sending oxygen from the air separation unit and a carbon containing substance to the gasifier and means for sending fuel from the gasifier to the combustor.

According to a still further aspect of the invention, there is provided a process for generating power and/or oxygen enriched fluid using an integrated power generation system comprising compressing air in a first compressor, sending air from the first compressor to a combustor and to a first air separation unit, sending nitrogen from the air separation unit to a point upstream of an expander, sending fuel to the combustor, sending combustion gas from the combustor to the expander and either compressing the nitrogen sent to a point upstream of expander, further compressing the air sent to the first air separation unit from the first compressor or expanding the air sent to the combustor from the first compressor characterized in that the first air separation unit comprises at least one column and the process comprises feeding a column of the first air separation unit column with air, sending liquid nitrogen from an external source to the top of the single column, the external source not being a condenser fed by gaseous nitrogen from the top of the s column and removing gaseous nitrogen from the top of the single column and an oxygen enriched fluid from the bottom of the column.

Further features of the process may include:

said column having no bottom reboiler and no top condenser;

sending air from a second compressor to the single column;

the external source being a second air separation unit comprising at least one column the external source comprises a high pressure column and a low pressure column which are thermally linked;

withdrawing the liquid nitrogen from the high pressure column, pressurizing and sending it to the top of the column of the first air separation unit;

sending the liquid from the bottom of the single column to the second air separation unit, optionally to the high pressure column or low pressure column of the second air separation unit;

sending air to the second air separation unit from one of the first, second or a third compressor;

sending gaseous nitrogen from the column of the first air separation unit to the second air separation unit;

means for sending nitrogen from the second air separation unit to a point upstream of the expander;

wherein the column of the first air separation unit operates at between 8 and 35 bar;

the highest pressure of the second air separation unit is between 5 and 25 bar;

the amount of air sent from the first compressor to the first air separation unit and the amount of nitrogen sent upstream of the expander differ by no more than 10%, preferably 5%;

all the nitrogen originates from the first air separation unit;

the nitrogen originates from the first air separation unit and the external source;

the external source is the second air separation unit.

In particular the process may be an integrated gasification combined cycle process in which oxygen from the air separation unit is sent to gasify a carbon containing substance thereby producing fuel for the combustor.

BRIEF DESCRIPTION OF THE DRAWING

The invention will now be described in further detail with reference to the FIGS. 3 to 6 which are schematic flow sheets of an integrated air separation unit for use in an integrated power generation system.

DETAILED DESCRIPTION OF THE INVENTION

Cryogenic technology is the basic technology for large air separation plants.

Figure 1:
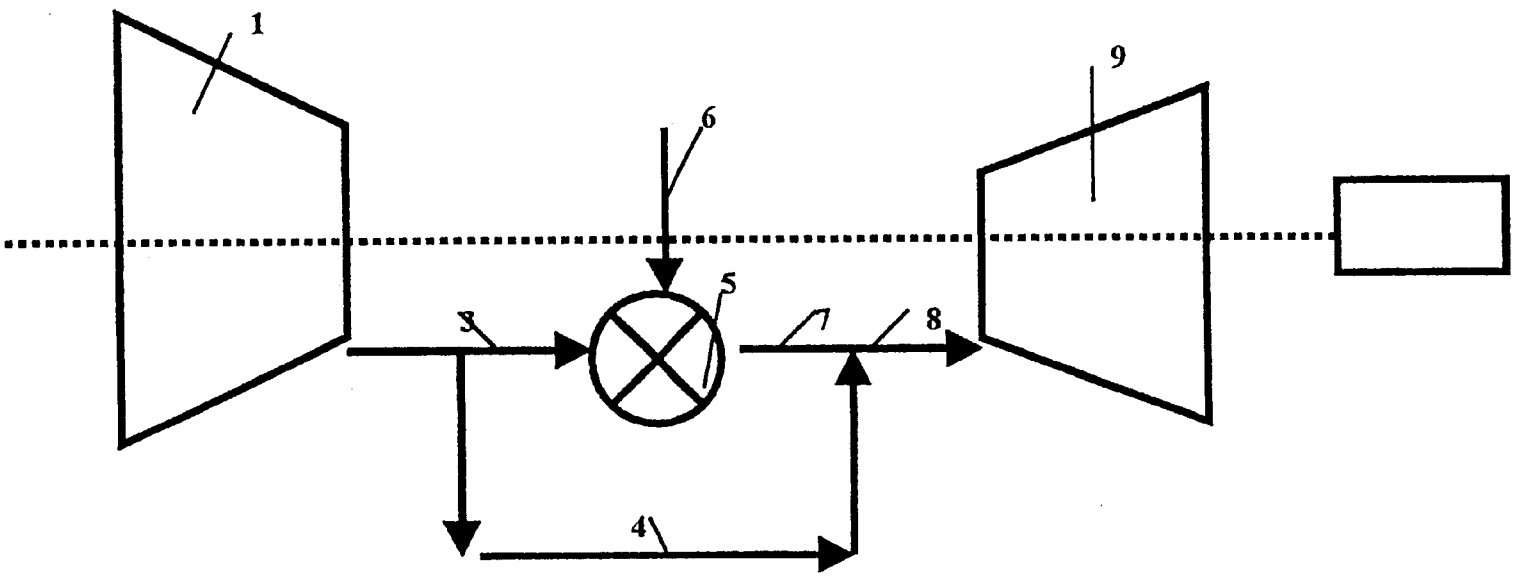
Figure 2:
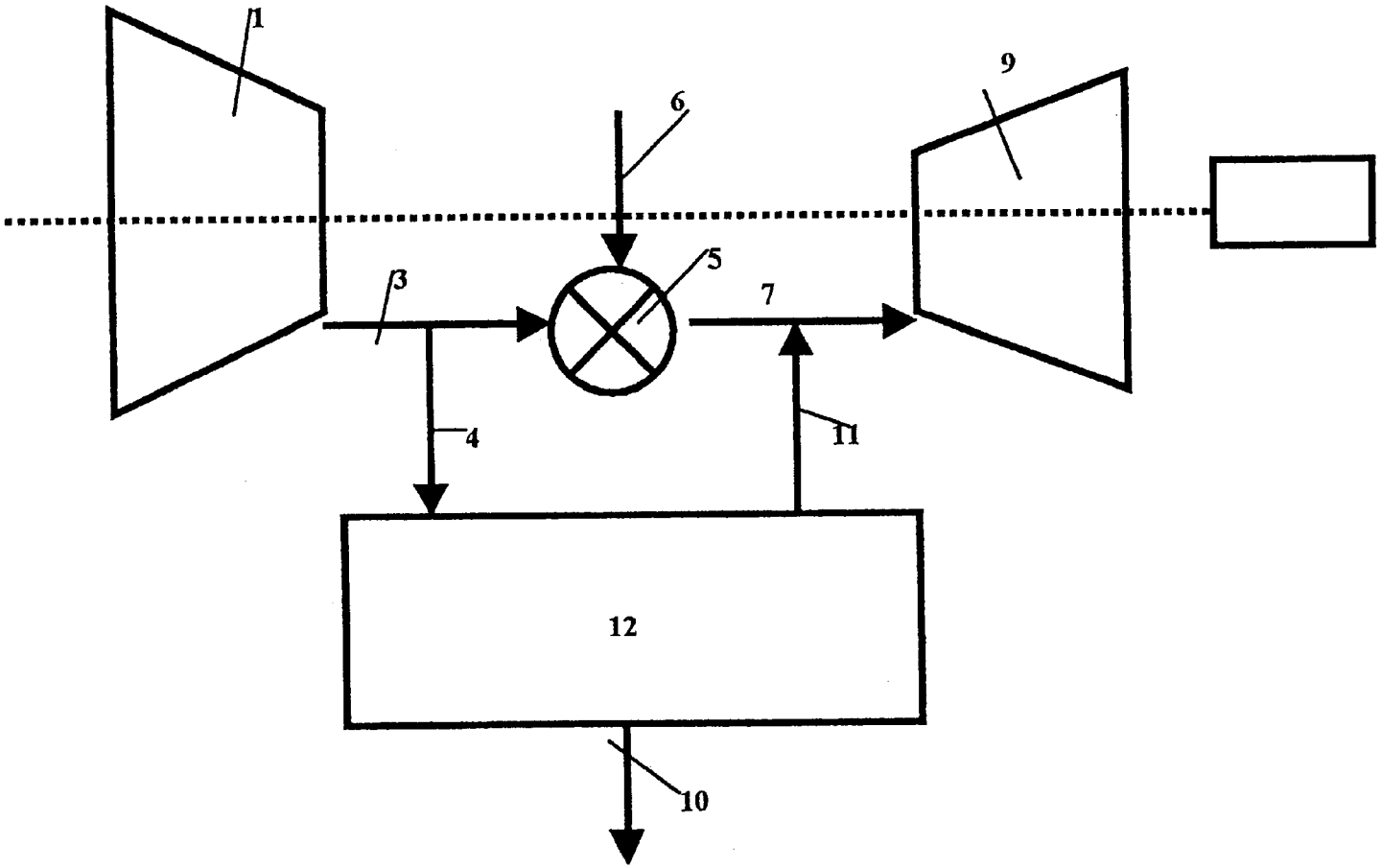
Figure 3:
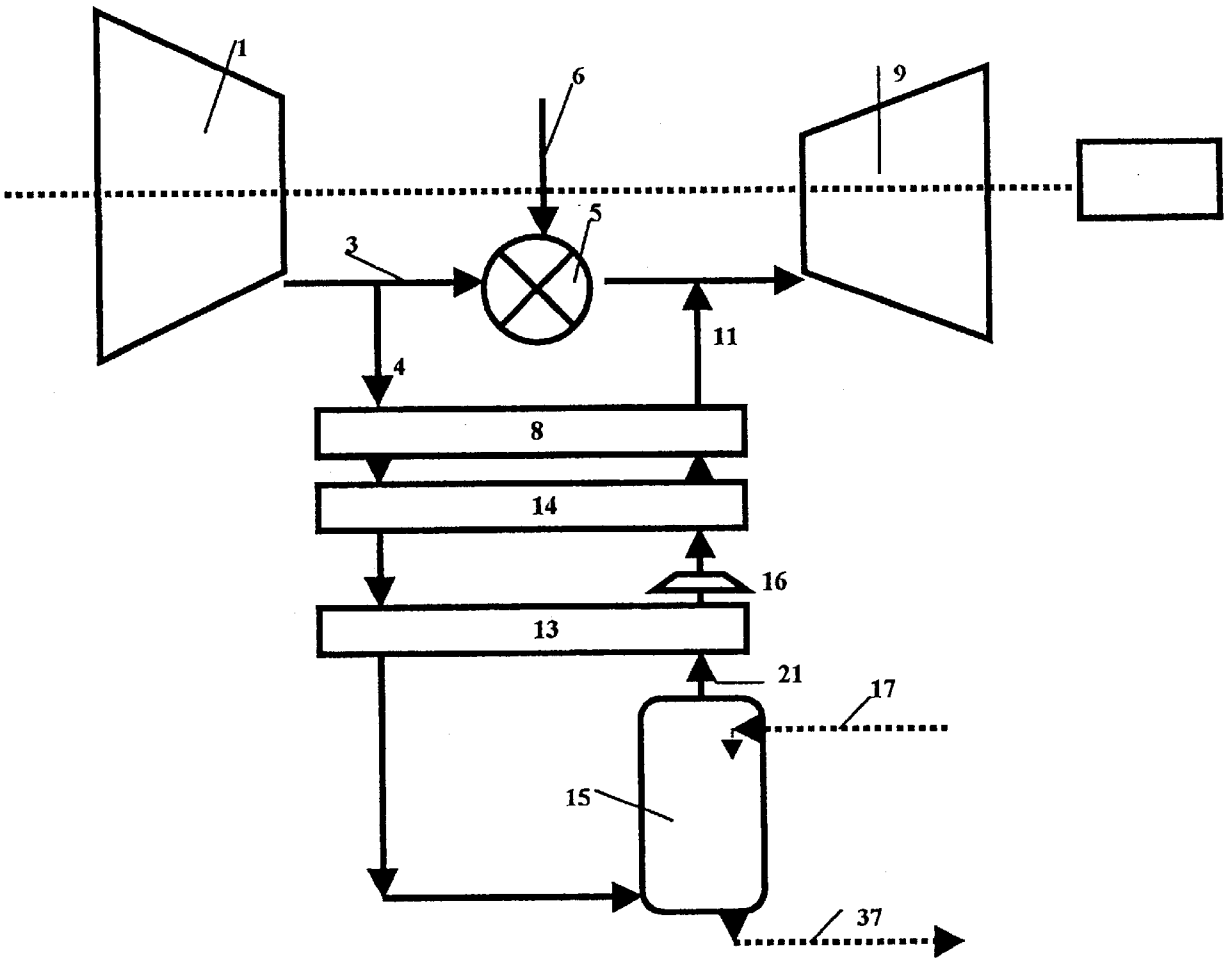
Figure 4:
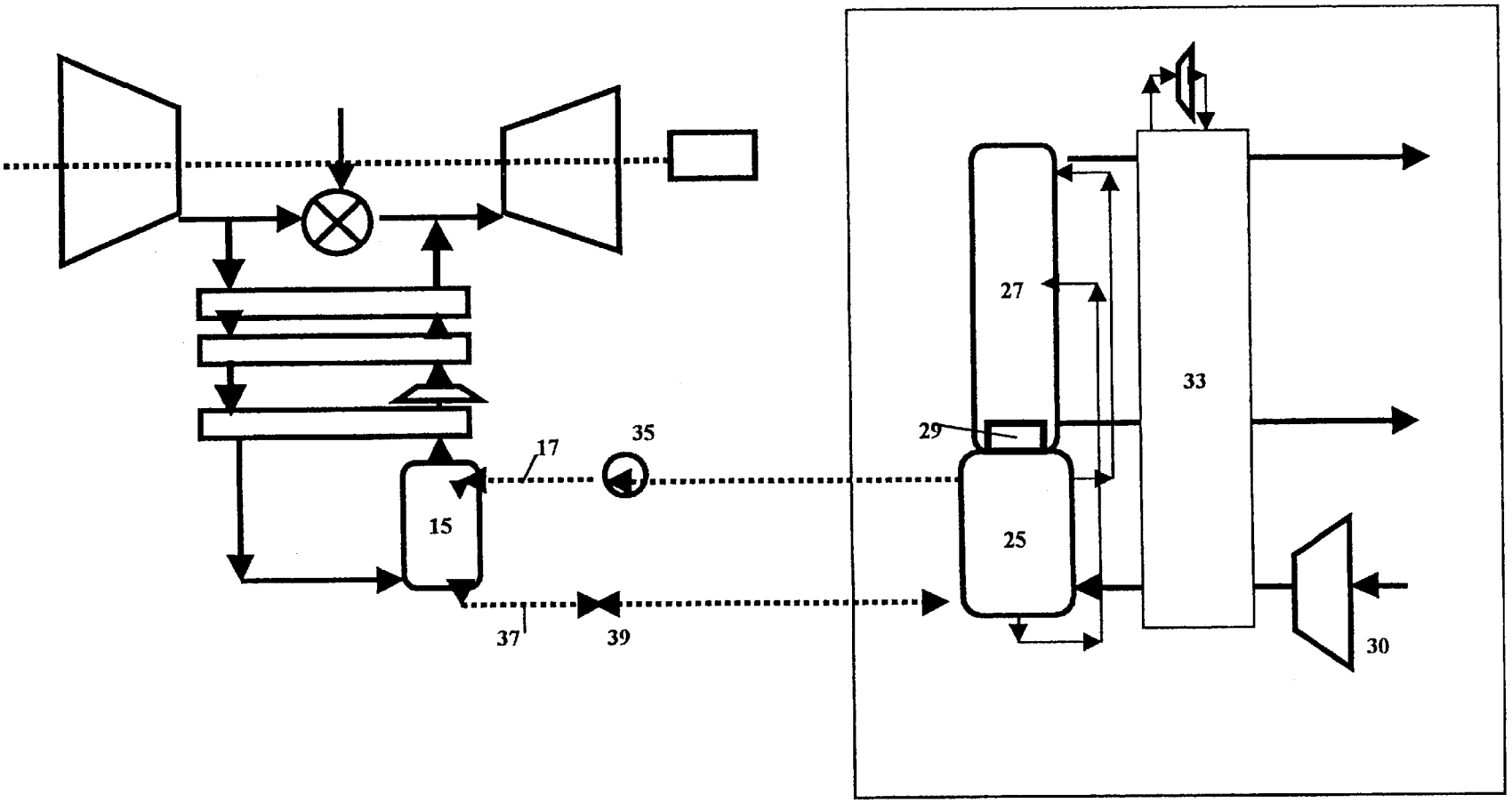
Figure 5:
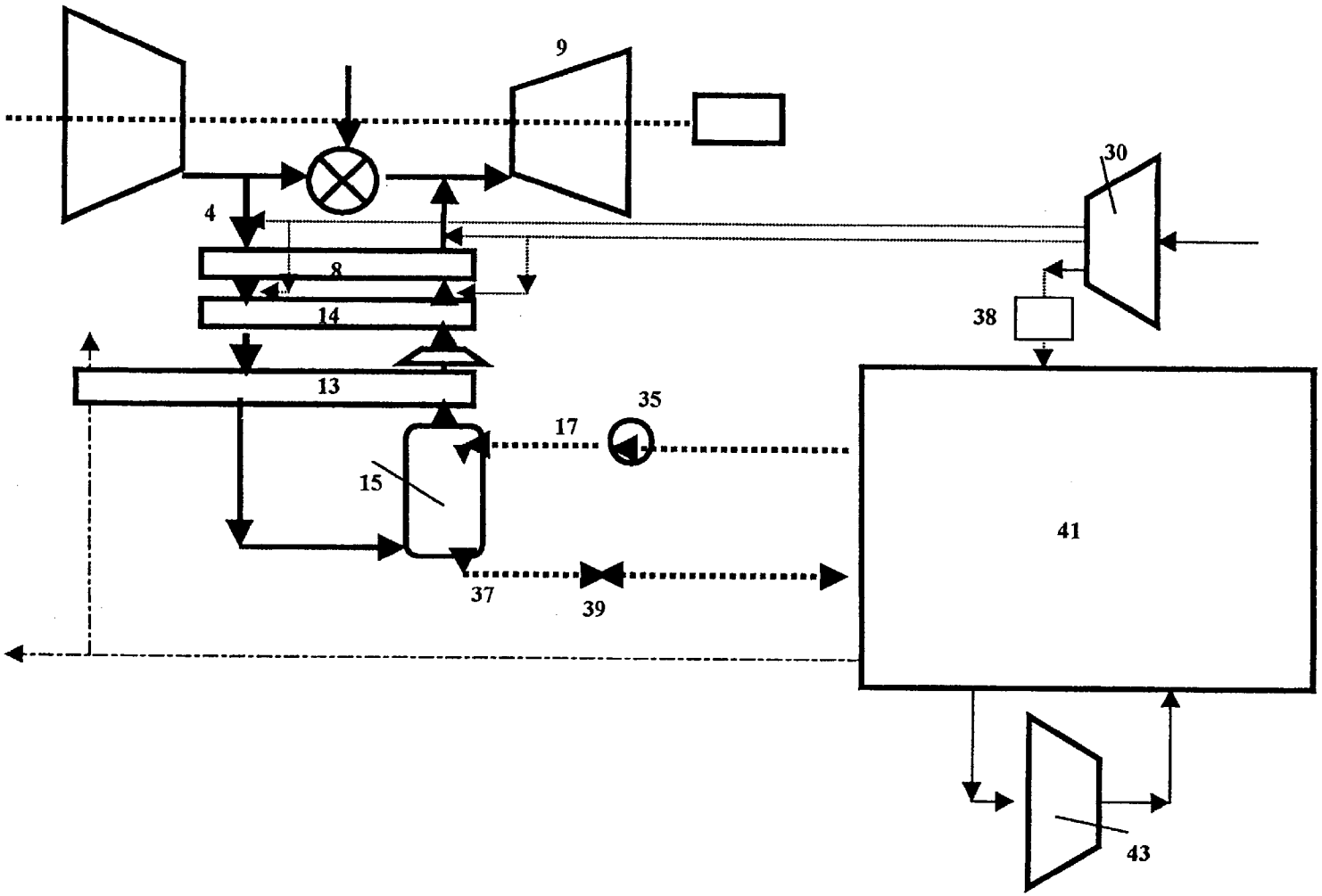
Figure 6:
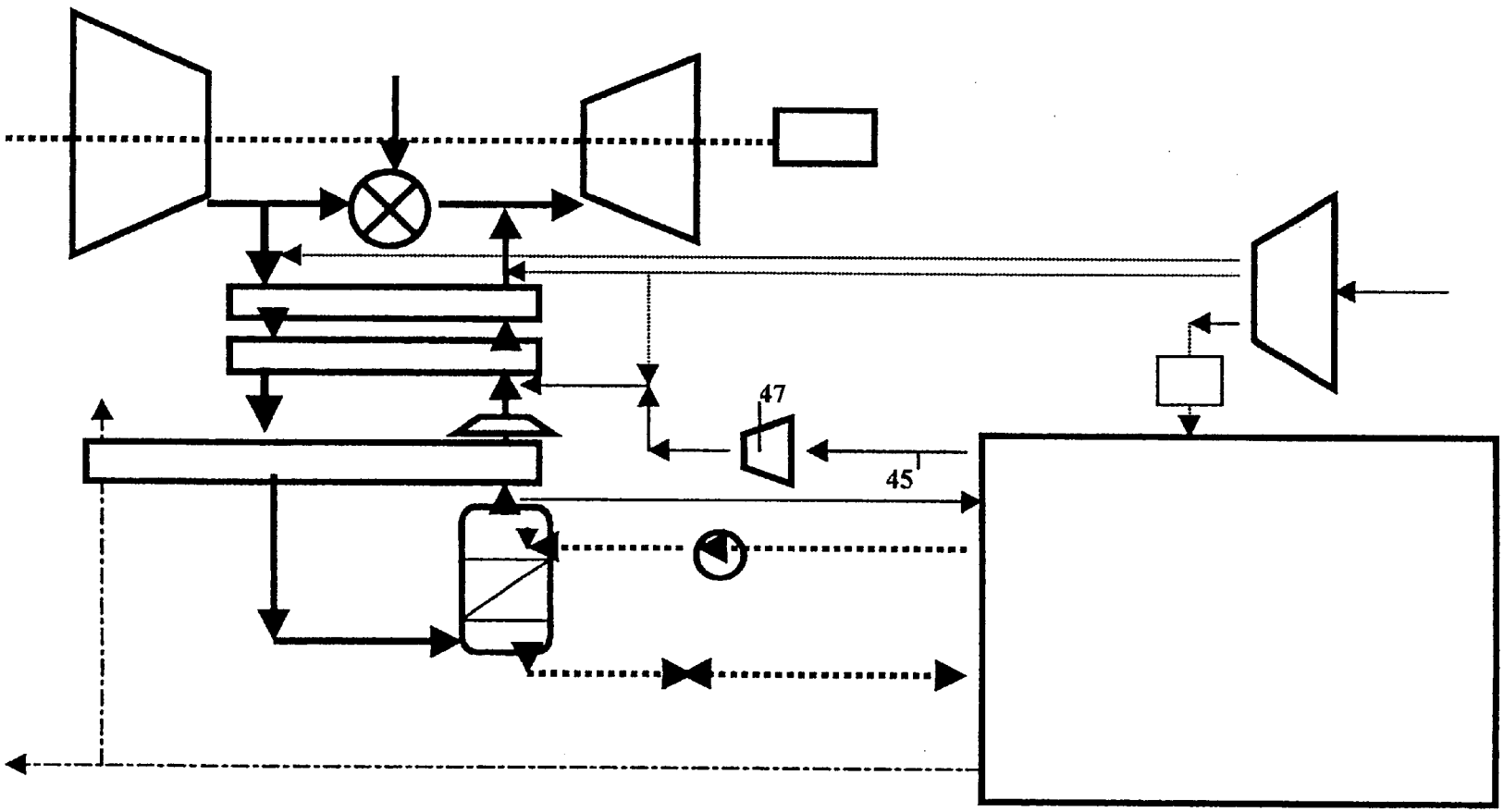

In the process of FIG. 3, air is compressed to between 8 and 35 bar in compressor 1. Air stream 3 is sent to combustor 5 where it is burnt with fuel 6. Air stream 4 is cooled in heat exchanger 8, purified in purifying unit 14 and then cooled in heat exchanger 13 to a temperature suitable for cryogenic distillation. It is then sent to a first air separation unit, in this case a wash column 15 which is a single column fed at the top by a liquid nitrogen wash stream 17 which may be pure or contain up to 5% oxygen. Various sources for the liquid are shown in FIGS. 4 to 6.

Liquid containing between 27 to 40% oxygen is removed from the bottom of column 15. Gaseous nitrogen 21 is removed from the column at a pressure between 8 and 25 bar, warmed in exchangers 13,8, reactivates air purification 14, compressed and mixed either with the combustion gas as shown or with air stream 3. The mixture thus formed is sent to expander 9 producing external work The nitrogen is compressed in a booster 16 at ambient temperature but may be compressed at sub-ambient or super-ambient temperatures so as to make up for the pressure drop in the exchangers and column. Alternatively air stream 4 may be boosted at any of the temperatures described. A less economical option would be to expand the feed air 3 slightly before sending it to the combustor.

When the air separation from our gas turbine by-pass is done using a liquid nitrogen wash column 15 (FIG. 3), we get the following advantages:

all heat exchange (hot and cold) and purification are carried out at elevated pressure thus reducing investment and energy drop cost;

the nitrogen wash column 15 is fed by liquid nitrogen, and very impure oxygen is removed in liquid rich phase. These liquids easily can be pumped and expanded, thus rending this wash totally independent of the rest of the oxygen process;

gaseous nitrogen flow at the outlet of the wash column 15 is almost equal to the air flow at the inlet of this column, thus maintaining the perfect balance of the gas turbine.

In the version of FIG. 4, the liquid nitrogen for the wash column 15 is derived from a second air separation unit comprising a double column with a high pressure column 25 and a low pressure column 27 thermally linked via a reboiler condenser 29 as in standard plants. The system may additionally include an argon separation column fed by the low pressure column. The operating pressures preferably vary between 5 and 25 bar for the high pressure column.

The air for the double column comes from a compressor 30 and is sent to the high pressure column 25 after cooling in exchanger 33. Oxygen enriched and nitrogen enriched liquids are sent from the high pressure column to the low pressure column as reflux. The system may use a Claude turbine, an turbine feeding air to the low pressure column or a nitrogen turbine to produce refrigeration.

Gaseous oxygen is produced from the low pressure column either directly or by vaporizing liquid oxygen. Waste nitrogen is withdrawn from the low pressure column.

Liquid nitrogen 17 from the top of the high pressure column 25 is sent to the top of wash column 15 following pumping in pump 35. Liquid 37 from the bottom of column 15 is expanded in a valve 39 and sent to the bottom of the high pressure column or to the low pressure column.

A standard cryogenic oxygen plant has a medium pressure column with liquid nitrogen at the top and oxygen rich liquid at the bottom. If one installs a gas turbine next to an oxygen plant to produce electric power (for the oxygen plant or not) or to produce a combination of power and steam (cogeneration), further arrangement can be made.

With the arrangement of FIG. 4, some liquid nitrogen or poor liquid 17 can be withdrawn from the medium pressure column or any other point of the process such as the low pressure column. It can be pumped to the relevant pressure in order to feed the nitrogen wash column. The corresponding rich liquid 37 will be returned to the low pressure column as the normal rich liquid. Thus some extra oxygen molecules will be fed to the column, allowing increased oxygen production (at the same or reduced purity, depending on the boosting ratio).

Obviously, this interesting process can be used in a grass root plant. In this case, a dedicated cold box will be better suited than a standard plant. Because oxygen is to be replaced by nitrogen or air for the gas turbine, some additional compressed air is needed. It can be injected (FIG. 5) either:

In the cold box 41 via compressor 30. The necessary pressure will be lower but a second air purification 38 is necessary;

Injected at the inlet of the turbine 9 (before or after the hot exchanger 8). No purification is necessary but the corresponding oxygen will be lost (Which is not a problem if the by-pass flow is sufficient for oxygen demand;

Mixed with the by-pass air 4 before nitrogen wash (before or after the hot exchanger 8). In that case the existing purification 14 can be used to purify the air.

In certain cases and depending on the final oxygen pressure required, a nitrogen (or air) recycle compressor 43 is necessary to adjust the separation power requirement of the oxygen separation and compression cycle. To maintain the advantages of the global pressurized cycle, this compressor will preferably receive air or nitrogen at medium pressure (above 3 bar).

Refrigeration from oxygen will be recovered in the cold box 41 or within the cold exchanger 13.

Because the gas at the top of nitrogen wash column is nitrogen, it can be used partly 45 to help the final distillation instead of the recycle compressor. The flow to the turbine can be readjusted as before with air or waste nitrogen recompression 47. It might have an advantage over a nitrogen recycle compressor as this compressed nitrogen will not need any final cooling (FIG. 6).

It will be appreciated that the external source for the liquid nitrogen could be a remote storage tank periodically replenished by tanker trucks or a liquefier in which gaseous nitrogen e.g. from a pipeline is condensed. The oxygen enriched liquid from the first air separation unit may then be sent to another column or another user, or to liquefy after expansion the gaseous nitrogen from the pipe-line.

In the case where the external source is a second air separation unit, this may be a single column air separator generating liquid nitrogen, a standard double column with or without minaret, an external condenser of an air separation column, a double column in which oxygen enriched liquid from the bottom of the low pressure column is fed to a top condenser of the low pressure column, a triple column in which rich liquid from a high pressure column feeds a medium pressure column and liquid from the medium pressure column feeds the low pressure column for example of the type shown in FR1061414 or EP538118.

The second air separation unit serving as an external source may produce other liquids in addition to the nitrogen and other gaseous products. Gases may be produced at high pressure by pumping and vaporizing liquids withdrawn from columns of the second air separation unit.

One advantage of the present system is that the first air separation unit and the second air separation unit can operate independently by providing storage tanks for the liquid nitrogen from the second air separation unit and the oxygen enriched liquid from the first air separation unit.

Thus when the second air separation unit is not operational, the first air separation unit draws liquid nitrogen from the storage. Similarly when the first air separation unit is not operational the oxygen enriched liquid is removed from the storage and sent to the second air separation unit.

What is claimed is:

1. An integrated apparatus for generating oxygen enriched fluid and/or power comprising a first air separation unit, a gas turbine comprising a combustor and an expander, a first compressor, means for sending air from the first compressor to the combustor and to the first air separation unit, means for sending combustor gases from the combustor to the expander, means for sending nitrogen from the first air separation unit to a point upstream of the expander and means for either compressing the nitrogen sent to a point upstream of expander, further compressing the air sent to the first air separation unit from the first compressor or expanding the air sent to the combustor from the first compressor characterized in that the first air separation unit comprises at least one column and the apparatus comprises means for sending liquid nitrogen from an external source to the top of the column, the external source not being a condenser fed by gaseous nitrogen from the single column and means for removing gaseous nitrogen from the top of the single column and for removing oxygen-enriched fluid from the bottom of the column.

2. An apparatus as claimed in claim 1 wherein said column has no bottom reboiler and/or no top condenser.

3. An apparatus as claimed in claim 1 comprising a second compressor and means for sending air from the further compressor to the column.

4. An apparatus as claimed in claim 1 wherein the liquid nitrogen external source is a second air separation unit comprising at least one column.

5. An apparatus as claimed in claim 4 wherein the second air separation unit comprises a high pressure column and a low pressure column thermally linked with one another and the liquid nitrogen is derived from one of the columns.

6. An apparatus as claimed in claim 5 comprising means for withdrawing the liquid nitrogen from the high pressure column, pressurizing and sending it to the top of the column of the first air separation unit.

7. An apparatus as claimed in claim 6 comprising means for sending the liquid from the bottom of the column of the first air separation unit to the second air separation unit.

8. An apparatus as claimed in claim 5 comprising sending air to the second air separation unit from one of the first, second or a third compressor.

9. An apparatus as claimed in claim 5 comprising means for sending gaseous nitrogen from the column of the first air separation unit to the second air separation unit.

10. An apparatus as claimed in claim 5 comprising means for sending nitrogen from the second air separation unit to a point upstream of the expander.

11. A process for generating power and/or oxygen enriched fluid using an integrated system comprising compressing air in a first compressor, sending air from the first compressor to a combustor and to a first air separation unit, sending nitrogen from the first air separation unit to a point upstream of an expander, sending fuel to the combustor, sending combustion gas from the combustor to the expander and either compressing the nitrogen sent to a point upstream of expander, further compressing the air sent to the first air separation unit from the first compressor or expanding the air sent to the combustor from the first compressor characterized in that the first air separation unit comprises at least one column and the process comprises feeding a column of the first separation unit with air, sending liquid nitrogen from an external source to the top of the column, the external source not being a condenser fed by gaseous nitrogen from the column and removing gaseous nitrogen from the top of the column and an oxygen enriched fluid from the bottom of the column.

12. A process as claimed in claim 11 wherein said column is a single column has no bottom reboiler and no top condenser.

13. A process as claimed in claim 11 comprising sending air from a second compressor to the first air separation unit.

14. A process as claimed in claim 11 wherein the external source comprises a second air separation unit comprising at least one column.

15. A process as claimed in claim 14 wherein the second air separation unit comprises a high pressure column and a low pressure column thermally linked with one another and the liquid nitrogen is derived from one of the columns.

16. A process as claimed in claim 15 comprising withdrawing the liquid nitrogen from the high pressure column, pressurizing and sending it to the top of the column of the first air separation unit.

17. A process as claimed in claim 15 comprising sending liquid from the bottom of the single column to the second air separation unit.

18. A process as claimed in claim 14 comprising sending air to the second air separation unit from one of the first, second or a third compressor.

19. A process as claimed in claim 14 comprising sending gaseous nitrogen from the column of the first air separation unit to the second air separation unit.

20. A process as claimed in claim 14 comprising means for sending nitrogen from the second air separation unit to a point upstream of the expander.

21. A process as claimed in claim 11 wherein the column of the first air separation unit operates at between 8 and 25 bar.

22. A process as claimed in claim 15 wherein the highest pressure of any column of the second air separation unit is column between 5 and 25 bar.

23. A process as claimed in claim 11 in which the amount of air sent from the first compressor to the first air separation unit and the amount of nitrogen sent upstream of the expander differ by no more than 10%.

24. A process as claimed in claim 23 wherein all the nitrogen originates from the first air separation unit.

25. A process as claimed in claim 23 wherein the nitrogen originates from the first air separation unit and the external source.

26. A process as claimed in claim 25 wherein the external source is a second air separation unit.

* * * * *